US006817029B2

(12) United States Patent
Mazzarolo

(10) Patent No.: US 6,817,029 B2
(45) Date of Patent: Nov. 16, 2004

(54) GARMENT WITH PROTECTED DEFORMABLE INSERTS

(75) Inventor: Gabriele Mazzarolo, Coste di Maser (IT)

(73) Assignee: Alpinestars Research SRL, Treviso (IT)

( * ) Notice: Subject to any disclaimer, the term of this patent is extended or adjusted under 35 U.S.C. 154(b) by 0 days.

(21) Appl. No.: 10/415,624

(22) PCT Filed: Jul. 30, 2002

(86) PCT No.: PCT/EP02/08462

§ 371 (c)(1),
(2), (4) Date: Apr. 29, 2003

(87) PCT Pub. No.: WO03/013294

PCT Pub. Date: Feb. 20, 2003

(65) Prior Publication Data

US 2004/0010835 A1 Jan. 22, 2004

(30) Foreign Application Priority Data

Aug. 10, 2001 (IT) ..... TV20010046 U

(51) Int. Cl.[7] ..... A41D 13/00

(52) U.S. Cl. ..... 2/22

(58) Field of Search ..... 2/22–24, 79, 227, 2/69, 455, 267, 62, 242

(56) References Cited

U.S. PATENT DOCUMENTS

| | | | | |
|---|---|---|---|---|
| 1,660,342 A | | 2/1928 | Levinson | |
| 3,878,561 A | | 4/1975 | Winiecki | |
| 4,773,100 A | | 9/1988 | Kuo | |
| 5,038,408 A | * | 8/1991 | DeBaene | 2/23 |
| 5,052,052 A | * | 10/1991 | Gilford et al. | 2/467 |
| 5,649,328 A | | 7/1997 | Martin | |

FOREIGN PATENT DOCUMENTS

| | | |
|---|---|---|
| EP | 0 950 360 | 10/1999 |
| WO | WO 010254 | 2/2001 |

* cited by examiner

*Primary Examiner*—Tejash Patel
(74) *Attorney, Agent, or Firm*—Katten Muchin Zavis Rosenman

(57) ABSTRACT

Garment in which there is provided at least a deformable insert (2, 3, 4) characterized in that it comprises a semi-rigid skirt (5, 6, 8) overlapping said deformable insert or at least a portion thereof.

7 Claims, 2 Drawing Sheets

GARMENT WITH PROTECTED DEFORMABLE INSERTS

The present invention refers to garments such as sportswear or leisurewear items including suits, trousers, jackets and the like.

In particular, the present invention is directed at those garments in which there are provided rigid or semi-rigid parts, such as knee guards, elbow guards or other protective elements, as well as deformable parts that are intended to facilitate the movements of the body, mainly in connection with the bending of the arms, the legs and the back.

Motor-cycling is a typical field of application in which garments of such a kind are used.

As a matter of fact, the jackets or the trousers that are usually worn by racing drivers or motor-cycling amateurs are made of a thick and resistant material such as leather or the like, sometimes reinforced with rigid plates aimed at withstanding abrasions occurring in the case of falls.

In addition, the garment zones corresponding to articulations of the body, such as the knees or the elbows, are specially protected by knee guards or elbow guards, which are of a rigid construction as well, so that the wearability of the garments of the above cited kind, notwithstanding the afore mentioned deformable parts with which they are provided, turns out to be practically limited Such parts may be made with the use of inserts of stretch fabric, rubber or the like, as well as any insert of a material configured so as to feature a plurality of pleats in the way of a bellows, so as to be able to freely deform, thereby compensating for the different postures taken by the human body.

An example of motor-cycling suit designed in accordance with these principles is described in the patent application EP-A-0 950 360.

Generally speaking, however, it should be anyway noticed that such deformable parts may bring about some difficulties that reduce the extent of the benefits deriving from the use thereof.

In fact, they turn into weak points in case of a fall, owing to the fact that stretch fabrics or the layers of material of which they are made cannot feature a same strength as the leather of which the suit, the trousers or the jacket in its entirety is made.

On the other hand, it can be readily appreciated that, owing to these portions having to be able to freely deform, no possibility is given for rigid reinforcement inserts to be included within said parts, either.

As a consequence of these circumstances, therefore, it is preferable that the size of such parts be kept as small as possible, so as to limit the extent of the weak points in the related garments.

However, too small a size of such parts does not allow for any adequate freedom of movement, especially if the fact is considered that such garments as motor-cycling suits, trousers and jackets have to fit the body of a person both when he/she is driving and when he/she is standing up, namely under widely differing circumstances.

It should also be duly considered that, when changing from a posture to another one, displacements occur which are due to the natural settling of the suit on the body of the person, and such displacements can actually cause the elastic parts to move out of place with respect to the zone of the body which they are associated with.

In an effort to at least partially solve these problems and meet all these different needs, intermediate solutions are used in the current state of the art, which represent a compromise between the comfortableness of persons wearing the garments and the required level of safety.

However, these solutions may prove fully inadequate in the case of more demanding applications, such as for instance in the case of motor-cycling races.

It is therefore a main object of the present invention to improve this state of things by providing a garment comprising deformable parts, which is particularly, although not solely intended for use in the motor-cycling sector, where it shall ensure a greater freedom of movement to persons wearing it as well as an adequate protection also in correspondence of the above mentioned parts.

Such an object is reached by a garment incorporating the characteristics as recited in the appended claims.

The features and advantages of the present invention can be more clearly understood from the description of a preferred, although not sole embodiment that is given below with reference to the accompanying drawing, in which.

Figure 2:
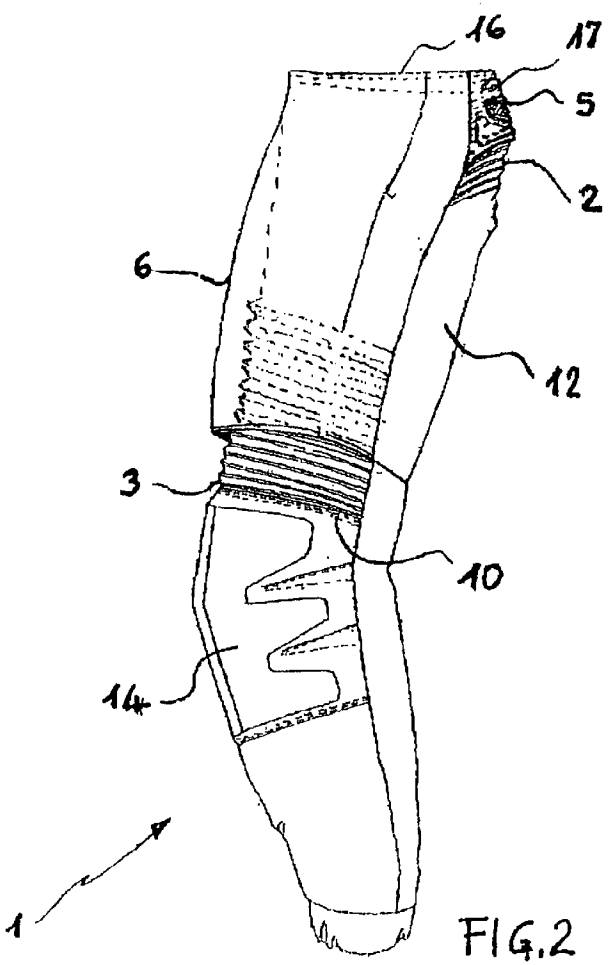
FIGS. 2 and 3 are side views of the trousers shown in FIG. 1, in the extended condition and the bent position of the leg, respectively.
Figure 1:
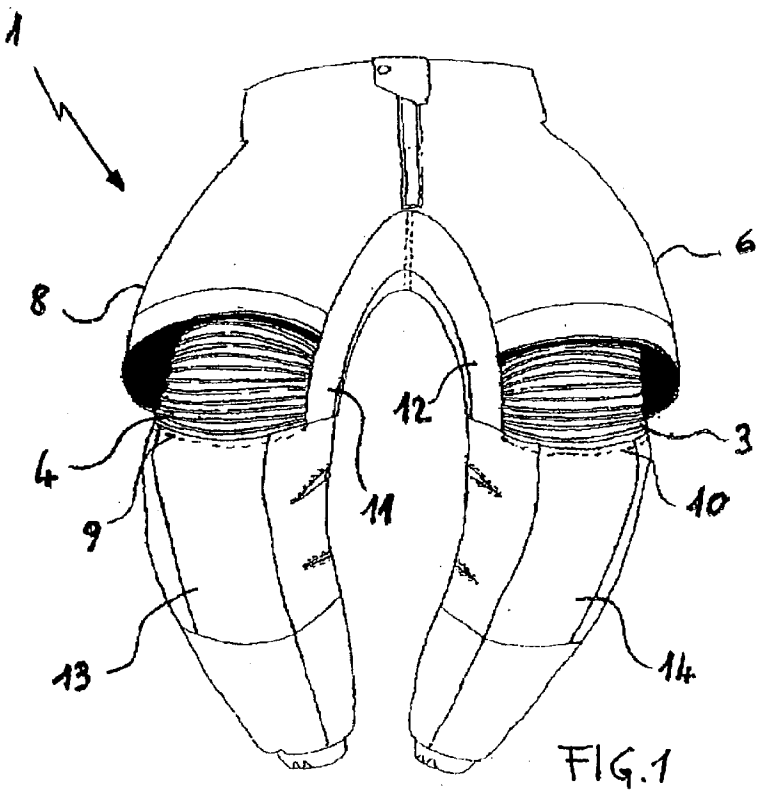
FIG. 1 is a front view of a pair of trousers according to the present invention.
Figure 4:
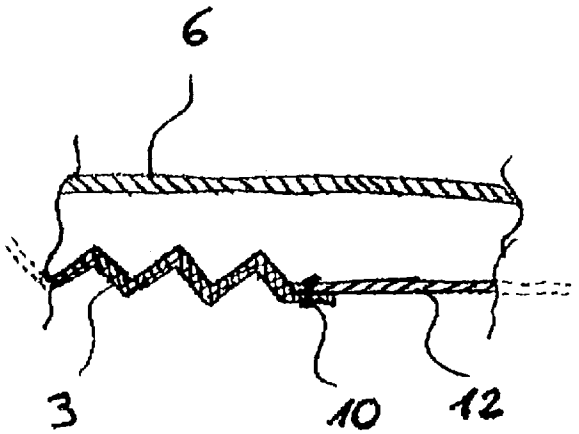
FIG. 4 is a cross-sectional enlarged view of the encircled detail appearing in FIG. 3.
Figure 3:
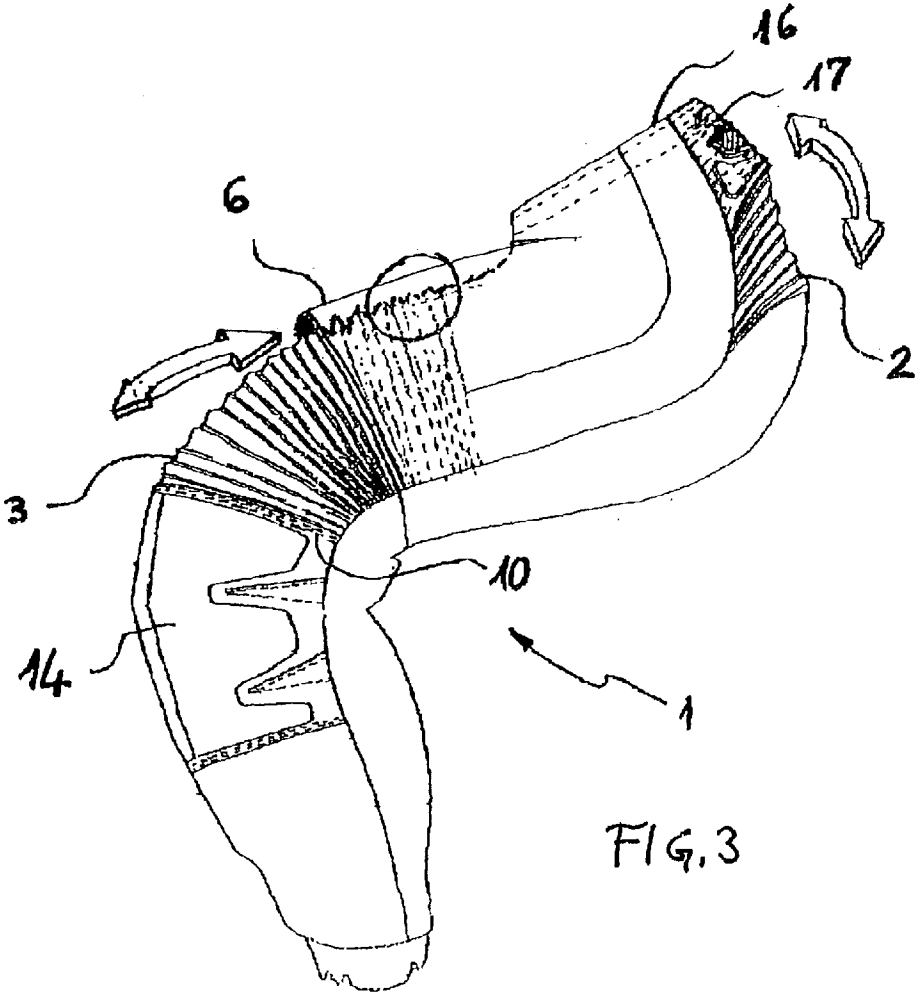

With reference to the above cited Figures, they can be noticed to generally indicate at 1 a pair of motor-cycling trousers according to the present invention, in which there are provided three deformable inserts 2, 3 and 4; the first such insert is located in correspondence of the rear zone and extends from the waistline of the trousers down to the coccygeal zone, whereas the other two inserts are arranged in a position situated slightly above the knee.

In this case, the inserts are of the bellows-like type made of any material that proves suitable to the purpose, such as for instance a natural or synthetic fabric, thin skin or leather, rubber or the like. However, it will be readily appreciated that any other solution that proves appropriate in view of making deformable inserts for use in garments, such as for instance stretch fabrics or the like, may also be used.

The inserts 2, 3 and 4 of the trousers extend in part under respective covering skirts 5, 6 and 8; these skirts are applied on to the trousers by means of sewing and/or bonding and are made of thick skin or leather, possibly reinforced by means of metal plates or other rigid elements, so as to be capable of withstanding abrasion in case of the motor-cyclist falling down.

The inserts 2, 3 and 4 are joined to the remaining portion of the trousers in any suitable per se known manner, by means of sewing or other joining techniques, depending on their position and which part of the trousers they are in proximity of.

As an example, the inserts 3 and 4 above the knee are joined by sewing seams 9 and 10 to their respective legs 11 and 10 of the trousers; the uppermost sewing seams are located under the skirts 6 and 8, whereas the lowermost ones are protected by knee guards 13 and 14.

Similarly, also the deformable insert 2 is joined to the waist 16 of the trousers by a sewing seam 17 lying under the covering skirt 5.

From the above description, the way in which the trousers 1 practically behave in use, thereby reaching the earlier stated object of the present invention, can be readily inferred.

In fact, thanks to the protection ensured by the skirts 5, 6 and 8, the deformable inserts 2, 3 and 4 can be assigned a greater extension than the currently known inserts used in sports suits or trousers, since there is no risk for them to become exposed in the case of the wearing person's falling from the motor-cycle.

Such a greater extension enables the inserts 2, 3 and 4 to anatomically conform to the corresponding zones of the body of the motor-cyclist, under any bent or stretched condition of the legs thereof; it therefore ensues that the thereby ensured freedom of movement is practically unlimited, without any loss of safety for the persons wearing the trousers owing to the presence of the skirts 5, 6 and 8 that protect the inserts in the case of a fall.

As already hinted earlier in this description, the trousers illustrated in the Figures are just an example of the present invention; in fact, the same teaching can actually be applied to motor-cycling suits and jackets, as well as to all such garments in which use is made of deformable inserts in view of facilitating movements. In this connection, just think for instance of the outfits for sports like hockey, ski, etc.

It will of course be appreciated that the inserts may also be located or lie in positions differing from those considered here above. So, for instance, they may be provided in correspondence of the elbows, the shoulders, the back or any other part of the body, depending from the particular type of garment which they are intended for.

What is claimed is:

1. A garment particularly intended for leisure or sporting activities, comprising:

a lower back portion and a pair of knee portions;

a deformable insert seamed into said garment and associated with each of said lower back and knee portions; and a semi-rigid skirt associated with each deformable insert and overlapping only a portion thereof such that each semi-rigid skirt overlies but does not completely cover its associated deformable insert.

2. A garment according to claim 1, wherein said deformable insert is made of one or more of the following materials; fabric, skin and rubber.

3. A garment according to claim 2, wherein said deformable insert is made of stretch fabric.

4. A garment according to claim 1, wherein each semi-rigid skirt comprises at least a reinforcement element in the form of a plate of material such as plastics or metal.

5. A garment according to claim 1, wherein each deformable insert is of the bellows-type.

6. A garment according to claim 1, further comprising knee guards integrally incorporated into said garment below and deformable inserts that are associated with said knee portions.

7. A garment particularly intended for leisure or sporting activities, comprising:

a lower back portion said a pair of knee portions;

a bellows-type deformable insert seamed into said garment and associated with each of said lower back and knee portions;

a semi-rigid skirt associated with each deformable insert and overlapping only a portion thereof such that each semi-rigid skirt overlies but does not completely cover its associated deformable insert; each semi-rigid skin comprising a plate-like reinforcement element; and knee guards integrally incorporated into said garment below said deformable inserts associated with said knee portions.

* * * * *

UNITED STATES PATENT AND TRADEMARK OFFICE

CERTIFICATE OF CORRECTION

PATENT NO. : 6,817,029 B2
APPLICATION NO. : 10/415624
DATED : November 16, 2004
INVENTOR(S) : Mazzarolo It is certified that error appears in the above-identified patent and that said Letters Patent is hereby corrected as shown below:

On the title page item (75),
The inventor name will be changed from "Gabriele Mazzarolo"
to --Giovanni Mazzarolo--

Signed and Sealed this

Third Day of April, 2007

JON W. DUDAS
*Director of the United States Patent and Trademark Office*